US011926464B2

(12) United States Patent
Wang et al.

(10) Patent No.: US 11,926,464 B2
(45) Date of Patent: Mar. 12, 2024

(54) MULTI-CHAMBER BEVERAGE CONTAINER

(71) Applicant: Daimay North America Automotive, Inc., Redford, MI (US)

(72) Inventors: Jianhua Wang, Novi, MI (US); Michael Steven Medoro, Livonia, MI (US)

(73) Assignee: Daimay North America Autmotive, Inc., Redford, MI (US)

( * ) Notice: Subject to any disclaimer, the term of this patent is extended or adjusted under 35 U.S.C. 154(b) by 1039 days.

(21) Appl. No.: 16/374,070

(22) Filed: Apr. 3, 2019

(65) Prior Publication Data

US 2019/0308793 A1 Oct. 10, 2019

Related U.S. Application Data

(60) Provisional application No. 62/653,214, filed on Apr. 5, 2018.

(51) Int. Cl.

| | |
|---|---|
| ***B65D 81/32*** | (2006.01) |
| ***B65D 8/00*** | (2006.01) |
| ***B65D 51/28*** | (2006.01) |
| ***B65D 85/72*** | (2006.01) |

(52) U.S. Cl.

CPC ..... *B65D 81/3216* (2013.01); *B65D 7/04* (2013.01); *B65D 51/2814* (2013.01); *B65D 81/3283* (2013.01); *B65D 85/72* (2013.01)

(58) Field of Classification Search

CPC ..... B65D 81/3216; B65D 81/3227; B65D 81/3283; B65D 51/2814; B65D 51/2828; B65D 51/2835; B65D 81/32; B65D 81/3222

USPC ..... 206/219, 222

See application file for complete search history.

(56) References Cited

U.S. PATENT DOCUMENTS

| | | | | |
|---|---|---|---|---|
| 4,264,007 | A * | 4/1981 | Hunt | B65D 51/2842 206/219 |
| 2006/0191805 | A1* | 8/2006 | Vogel | B65D 51/2864 206/222 |
| 2007/0215496 | A1* | 9/2007 | Scarborough | B65D 51/221 206/222 |
| 2009/0014449 | A1* | 1/2009 | Dverin | B65D 81/3222 220/501 |
| 2010/0224512 | A1* | 9/2010 | Boatner | B65D 17/4014 206/222 |
| 2011/0174642 | A1* | 7/2011 | Coon | B65D 51/2835 206/222 |
| 2013/0146485 | A1* | 6/2013 | Karabinis | B65D 25/00 206/219 |

(Continued)

*Primary Examiner* — Robert Poon

(74) *Attorney, Agent, or Firm* — Carlson, Gaskey & Olds. P.C.

(57) ABSTRACT

An example multi-chamber beverage container includes a first chamber containing a first fluid, a second chamber containing at least one second consumable item different than the first fluid, and a tab attached to a connector. The connector extends through the second chamber. The example multi-chamber beverage container further includes a first seal between the first chamber and the second chamber. The first seal is attached to the connector and is configured to be broken in response to activation of the tab to move the connector such that the first chamber and the second chamber are in fluid communication.

14 Claims, 3 Drawing Sheets

(56) References Cited

U.S. PATENT DOCUMENTS

| | | | | |
|---|---|---|---|---|
| 2014/0202895 | A1* | 7/2014 | Larson | B65D 25/08<br>206/222 |
| 2015/0016208 | A1* | 1/2015 | Larson | B65D 25/08<br>366/130 |
| 2015/0101942 | A1* | 4/2015 | Wu | B65D 51/2864<br>206/219 |

* cited by examiner

MULTI-CHAMBER BEVERAGE CONTAINER

PRIORITY CLAIM

This application claims priority to provisional application No. 62/653,214 filed on Apr. 5, 2018, the entirety of which is hereby incorporated by reference.

BACKGROUND

This disclosure relates to a beverage container and more particularly to a beverage container, and its use, having multiple chambers for different fluids that are arranged to be mixed when a consumer opens the container.

Beverage containers, such as aluminum cans, are known and used to contain a liquid for consumption by a consumer. In some instances, the liquid will be a soda, flavored beverage, or carbonated water. The beverage containers are typically sealed to preserve carbonation or other characteristics of the liquid that the consumer will end up drinking. For example, if the beverage container holds soda, the can is sealed to maintain the soda in a carbonated state and maintain the soda's characteristics and taste. Because of this seal, the consumer is unable to add additional liquids or other items to the contents of the beverage container.

SUMMARY

An example multi-chamber beverage container includes a first chamber containing a first fluid, a second chamber containing at least one second consumable item different than the first fluid, and a tab attached to a connector. The connector extends through the second chamber. The example multi-chamber beverage container further includes a first seal between the first chamber and the second chamber. The first seal is attached to the connector and is configured to be broken in response to activation of the tab to move the connector such that the first chamber and the second chamber are in fluid communication.

An example method of using a multi-chamber beverage container includes providing a multi-chamber beverage container including a first chamber, a second chamber, a tab attached to a connector, and a first seal attached to the connector. A first fluid is provided in the first chamber. At least one second consumable item different from the first fluid is provided in the second chamber. The first seal is broken by activation of the tab that moves the connector such that the first chamber and the second chamber are in fluid communication. The first fluid and the at least one second consumable item are mixed.

DETAILED DESCRIPTION

Figure 1:
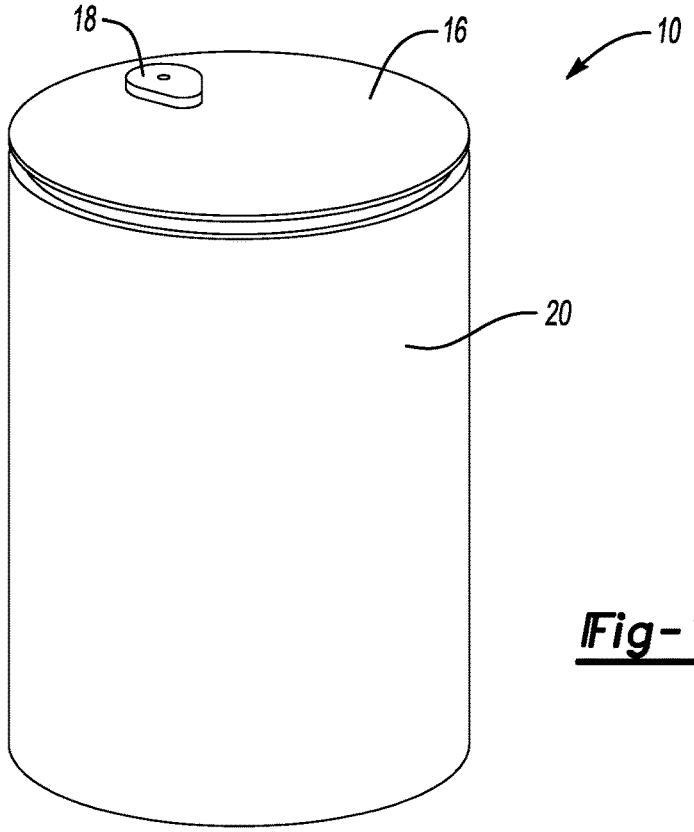
FIG. 1 is a perspective view of an example multi-chamber beverage container.
Figure 2:
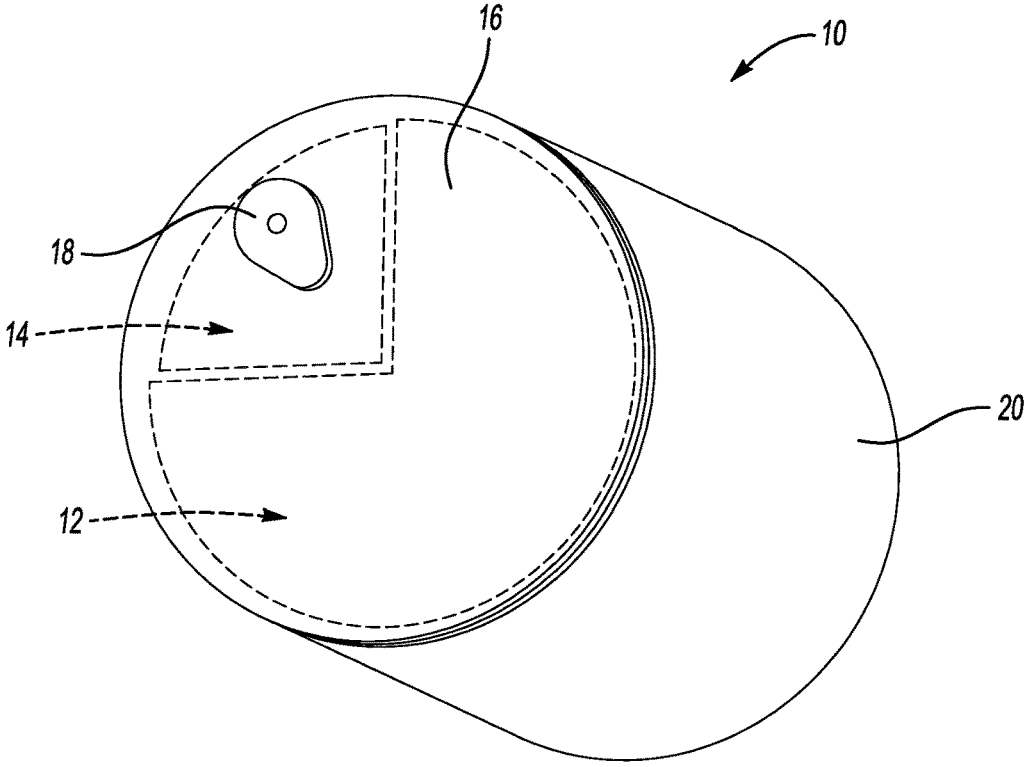
FIG. 2 is a top view of the example multi-chamber beverage container of FIG. 1.
Figure 3:
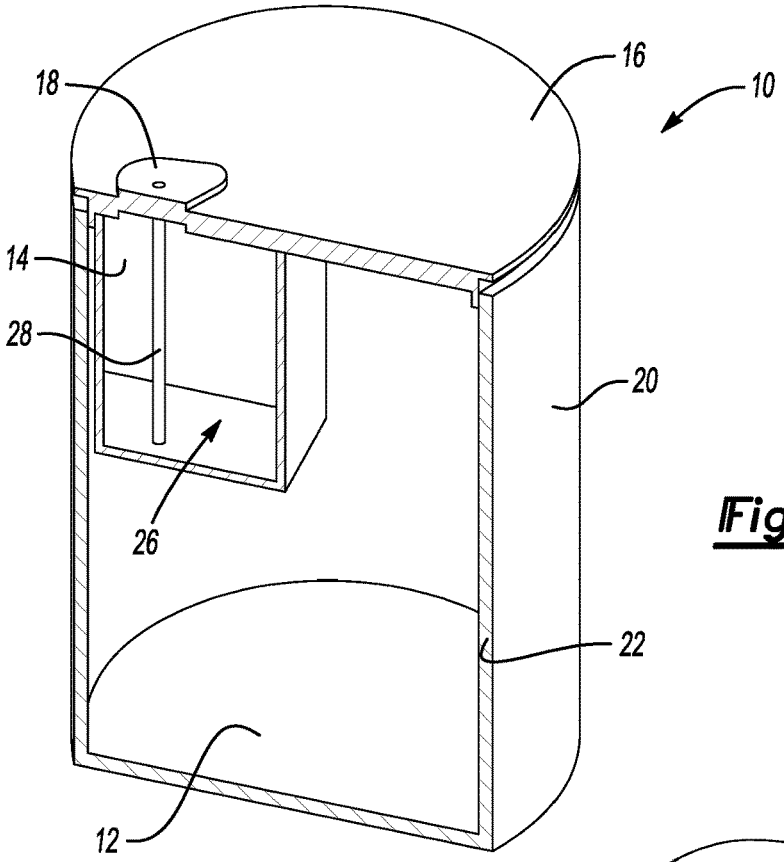
FIG. 3 is a cross-sectional view of the example multi-chamber beverage container of FIG. 1.
Figure 4:
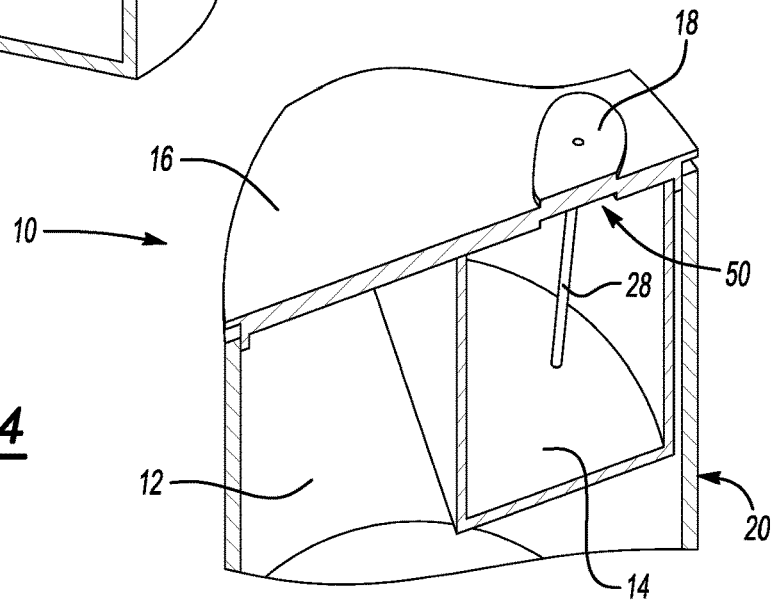
FIG. 4 is an enlarged view of a portion of the cross-sectional view of the example multi-chamber beverage container of FIG. 3.

Referring to FIGS. 1-4, an example multi-chamber beverage container 10 includes a first chamber 12, a second chamber 14, a top seal 16, a tab 18, and a body 20. The body 20 of the multi-chamber beverage container 10 includes a wall 22 that at least partially defines at least a portion of the first chamber 12 and the second chamber 14. In one example, the body 20 of the multi-chamber beverage container 10 is generally cylindrical. However, in other examples (not shown) the body 20 may have other geometric profiles such as rectangular, conical, or other desirable beverage container profiles.

Each of the first chamber 12 and the second chamber 14 are at least partially defined and enclosed by the top seal 16. Top seal 16 provides sealing against the body 20 of the multi-chamber beverage container 10 to seal and enclose the first chamber 12 and the second chamber 14. In this example, the top seal 16 has a geometry corresponding to the geometry of body 20 and is disposed near a first end 24 of the body 20. Tab 18 is connected to the top seal 16 near the first end 24 of the body 20. Tab 18 is moveable by the consumer to break the top seal 16 and create a first opening 50 (shown in FIG. 6) into the body 20 of the multi-chamber beverage container 10. In one example, tab 18 is pivoted by the consumer. In another example, the tab 18 may be pulled axially away from the first chamber 12 and the second chamber 14 to break top seal 16 and create the first opening 50 in the body 20.

In one example, body 20 and tab 18 are made of aluminum. In other examples, body 20 and tab 18 are made of at least one of plastic, paper, laminated material, other metal, or other beneficial material. In another example, body 20 and tab 18 are formed of the same material.

Both the first chamber 12 and the second chamber 14 are arranged to hold a consumable item. In one example, the consumable item is a fluid, such as a carbonated beverage, juice, alcoholic beverage, flavor syrup, or other fluid. Alternatively, the first chamber 12 or the second chamber 14 holds a solid consumable item or other flavoring item that can be used to flavor the fluid in the other chamber. By way of non-limiting example, the solid consumable item could be a piece of fruit, vegetable, block of sugar, or other non-liquid consumable item. In one example, either of the first chamber 12 and the second chamber 14 are arranged to hold both a fluid and a solid consumable item.

The second chamber 14 is sealed from the first chamber 12 by a bottom seal 26. In this example, the bottom seal 26 is a wall. The bottom seal 26 is connected to the tab 18 by a connector 28, such as a rod or post. Connector 28 passes through the second chamber 14. In one example, the connector 28 passes through an entire length of the second chamber 14. In one example, the connector 28 pass through at least a portion of the second chamber 14. Activation, or pulling, of the tab 18 results in activation, or pulling, of the connector 28 thereby breaking at least a portion of the bottom seal 26 such that the second chamber 14 is no longer fluidly separated from the first chamber 12. When the bottom seal 26 is broken, the first chamber 12 and the second chamber 14 are in fluid communication. Activation of the tab 18 also breaks the top seal 16 such to allow fluid to exit the body 20 of the multi-chamber beverage container 10. In one example, the tab 18 is at a first end of the second chamber 14 and the bottom seal 26 is at a second, opposite end of the second chamber 14.

Various non-limiting arrangements of the first chamber 12 and the second chamber 14 are contemplated by this disclosure. In one example, the second chamber 14 is disposed at least partially within the first chamber 12. In another example, the second chamber 14 is entirely disposed within the first chamber 12. In one example, the second chamber 14 holds a fluid that only partially fills the second chamber 14 such that the remainder of the second chamber 14 is filled with air.

In one example, the second chamber 14 is generally smaller than the first chamber 12. In one example, a volume of the second chamber 14 is about 25% of the total volume of the multi-chamber beverage container 10. In another example, a volume of the second chamber 14 is about 12.5% of the total volume of the multi-chamber beverage container 10. In another example, the second chamber is between about 10% and about 50% of the volume of the multi-chamber beverage container 10. In another example, the second chamber 14 has a height 30 that is sufficient to allow a non-fluid food item, such as a lemon, lime, or other fruit, to be disposed within the second chamber 14.

Figure 5:
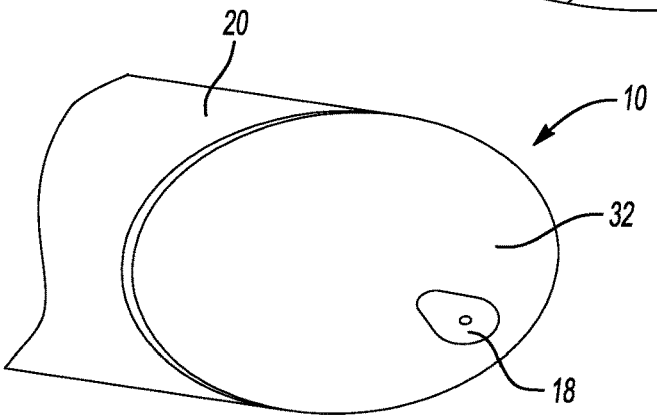
FIG. 5 is a top view of the example multi-chamber beverage container of FIG. 1 with a lid.

Referring to FIG. 5, with continued reference to FIGS. 1-4, a lid 32 attaches to the first end 24 of the body 20. The lid 32 is arranged to keep tab 18 from deploying until the ready for use by the consumer. In one example, the lid 32 is attached to the tab 18 such that when the consumer opens the lid 32, the tab 18 is lifted and activated, and the connector 28 is activated as previously described. In another example, the lid 32 is separately removable from the tab 18 and the consumer can remove lid 32 without activating tab 18.

Figure 6:
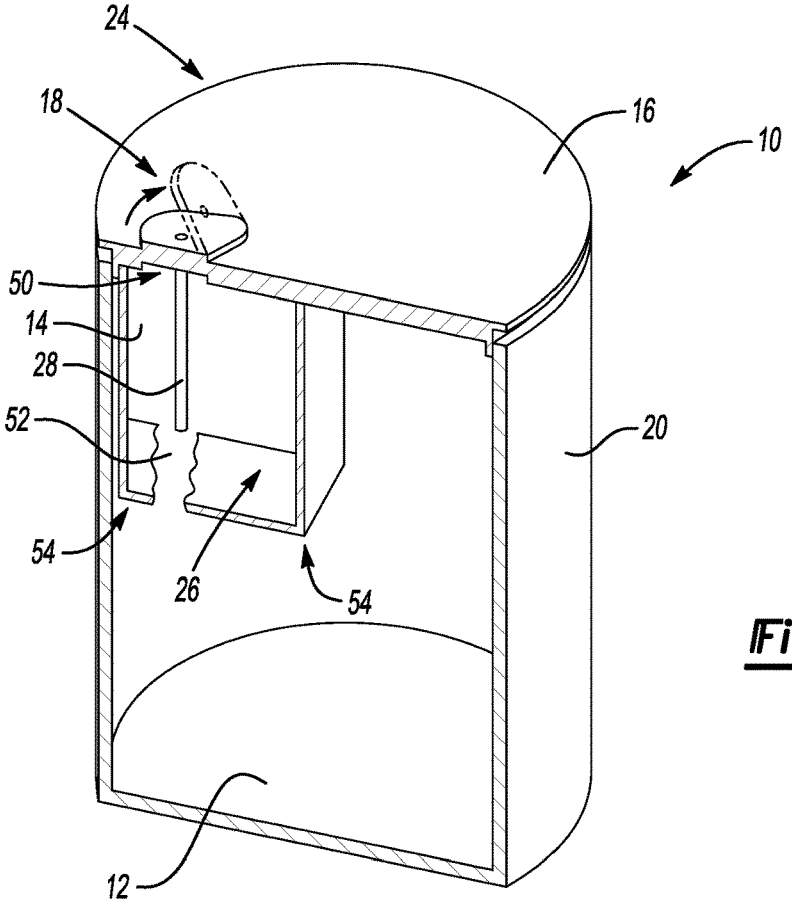
FIG. 6 is a cross-sectional view of the example multi-chamber beverage container of FIG. 1 with a tab activated and seals broken.

Referring to FIG. 6, the multi-chamber beverage container 10 is shown with tab 18 activated such that top seal 16 and bottom seal 26 are broken. Breaking the top seal 16 provides a first opening 50 for fluid to exit the body 20. The first opening 50 is sized to allow fluid to flow out of the multi-chamber beverage container 10 in a manner suitable for consuming by a consumer. Breaking the bottom seal 26 provides a second opening 52 for fluid be communicated between the first chamber 12 and second chamber 14. The second opening 52 may be formed through a portion of the bottom seal 26, as shown in FIG. 6. In one example, a piece of the bottom seal 26 breaks away to provide second opening 52 in the bottom seal 26 when pulled by connector 28. In one example, connector 28 pulls the entire bottom seal 26 such that second opening is provided near a side edge 54 of the second chamber 14. With the top seal 16 and bottom seal 26 broken, the first chamber 12 and second chamber 14 are in fluid communication such that the contents of the first chamber 12 and the second chamber 14 mix.

Figure 7:
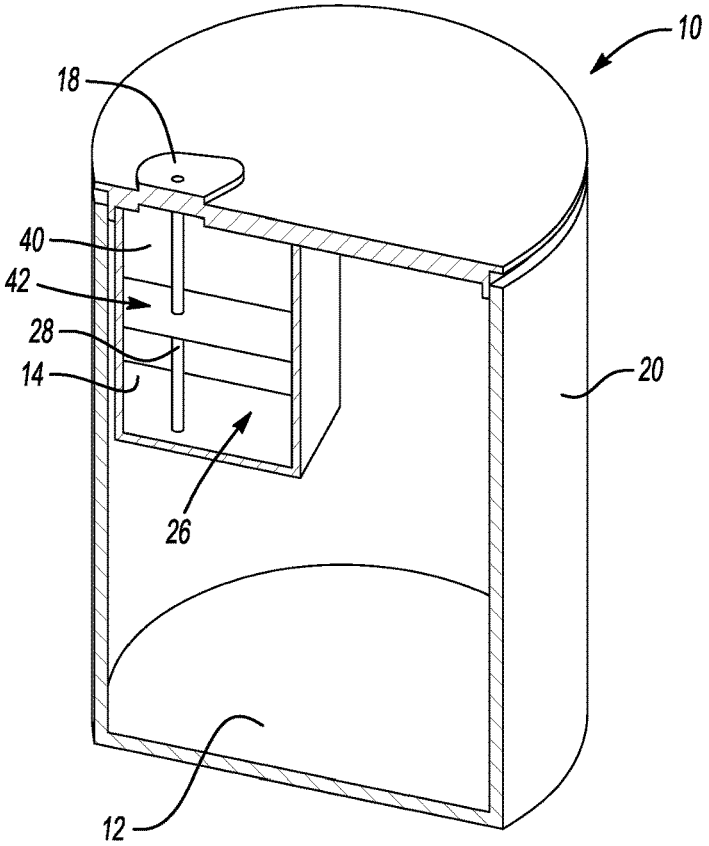
FIG. 7 is a cross-sectional view of an example multi-chamber beverage with three chambers.

Referring to FIG. 7, with continued reference to FIGS. 1-6, the example multi-chamber beverage container 10 is shown with a third chamber 40. The third chamber 40 is provided by a third seal 42 arranged in a similar manner as second chamber 14 and bottom seal 26. The third seal 42 is connected to the connector 28 and tab 18 in a similar manner as bottom seal 26. In this example, activation, or pulling, of the tab 18 results in activation, or pulling, of the connector 28 thereby breaking the top seal 16, bottom seal 26, and third seal 42 and placing each of the first chamber 12, second chamber 14, and third chamber 40 in fluid communication such that the contents of each chamber mix. Although shown with two or three chambers, it is within the contemplation of this disclosure to use any number of chambers within the body 20 of the multi-chamber beverage container 10. Additional chambers may employ any of the features described herein with regards to the first chamber 12, second chamber 14, or third chamber 40 and may be sealed using any of the features related to top seal 16, bottom seal 26, or third seal 42. In this example, all other features described herein regarding the multi-chamber beverage container 10 and its use remain the same.

In use, the first chamber 12 and second chamber 14 each hold a different fluid or other item to be mixed together. When the consumer is ready to drink the beverage, the consumer removes the lid 32 and activates the tab 18. Activation of the tab 18 removes, or opens, the bottom seal 26 such that first chamber 12 is in fluid communication with second chamber 14. Once in fluid communication, the contents of the first chamber 12 and the second chamber 14 are mixed for the consumer to drink. In this manner, the contents of the first chamber 12 and the second chamber 14 are not mixed until the consumer is ready to consume the beverage, removes the lid 32, and opens the multi-chamber beverage container 10 by activating the tab 18. The multi-chamber beverage container 10 maintains the original characteristics of the contents in each chamber 12, 14 until the consumer is ready to consumer the beverage. In use, in an example including a third chamber 40 and third seal 42, the third chamber 40 and third seal 42 operate in the same manner as the second chamber 14 and bottom seal 26 such that activation of the tab 18 removes, or opens, the third seal such that the third chamber 40 is in fluid communication with the second chamber 14 and/or the first chamber 12.

Although preferred embodiments have been disclosed in this disclosure, a worker of ordinary skill in this art would recognize that certain modifications would come within the scope of this disclosure. For that reason, the following claims should be studied to determine the true scope and content of this disclosure.

What is claimed is:

1. A multi-chamber beverage container comprising:

a first chamber containing a first fluid;

a second chamber containing at least one consumable item different than the first fluid;

a third chamber containing at least one additional consumable item different than the first fluid, wherein the second chamber and the third chamber are at least partially disposed within the first chamber;

a tab attached to a connector, wherein the connector extends through the second chamber and the third chamber, wherein the third chamber is disposed between the tab and the second chamber;

a bottom seal between the first chamber and the second chamber at a first end of the second chamber, wherein the bottom seal is attached to the connector and is configured to be broken in response to activation of the tab to create a first opening such that the first chamber and the second chamber are in guide communication through the first opening;

a middle seal at a second end of the second chamber and a first end of the third chamber, wherein the middle seal is attached to the connector and is configured to be broken in response to activation of the tab to create a second opening such that the second chamber and the third chamber are in fluid communication through the second opening;

a top seal at a second end of the third chamber opposite the first end of the third chamber, wherein the top seal is attached to the connector and is configured to be broken in response to activation of the tab to create a third opening such that fluid can exit the multi-chamber beverage container by passing through the third chamber and the third opening;

wherein the tab is generally disposed near the second end of the third chamber and near the top seal, and the bottom seal is generally disposed at the second end of the second chamber opposite the third chamber, wherein the middle seal is disposed between the top seal and the bottom seal; and wherein the first opening, the second opening and the third opening are arranged to be created at the same time when the tab is activated such that the first chamber, second chamber, and third chamber are in fluid communication.

2. The multi-chamber beverage container of claim 1, wherein the second chamber is about 12.5% to about 25% of the entire volume of the multi-chamber beverage container.

3. The multi-chamber beverage container of claim 1, wherein the connector is a linear rod.

4. The multi-chamber beverage container of claim 1, wherein the at least one consumable item in the second chamber is a solid consumable item.

5. The multi-chamber beverage container of claim 1, wherein the tab is arranged to be activated by pivoting in relation to the middle seal.

6. The multi-chamber beverage container of claim 1, further comprising a lid arranged to keep the tab from deploying until the lid is removed.

7. The multi-chamber beverage container of claim 6, wherein the lid is attached to the tab such that when a consumer lifts the lid to remove the lid, the tab is activated and lifted and the connector moves in a direction toward the top seal.

8. The multi-chamber beverage container of claim 1, wherein each of the first chamber, the second chamber, and the third chamber include a different food item, wherein each of the first chamber, the second chamber, and the third chamber is sealed with the food item contained therein.

9. The multi-chamber beverage container of claim 1, wherein the second chamber has a height sufficient to contain a non-fluid food item.

10. The multi-chamber beverage container of claim 1, wherein the pivoting of the tab causes the connector to move in a direction toward the top seal.

11. The multi-chamber beverage container of claim 1, wherein activation of the tab pulls the connector thereby breaking the top seal, the middle seal, and the bottom seal.

12. The multi-chamber beverage container of claim 1, wherein the second chamber and the third chamber remain at least partially within the first chamber after the top seal, middle seal, and the bottom seal are broken such that fluid is communicated through the first opening, the second opening, and the third opening simultaneously.

13. The multi-chamber beverage container of claim 2, wherein an outer circumferential perimeter of the second chamber and an outer circumferential perimeter of the third chamber are less than half an outer circumferential perimeter of the first chamber.

14. The multi-chamber beverage container of claim 7, wherein the connector is a linear rod.

* * * * *